US012487056B2

(12) United States Patent
Bosley et al.

(10) Patent No.: US 12,487,056 B2
(45) Date of Patent: Dec. 2, 2025

(54) SENSOR FARM

(71) Applicants: Ryan T. Bosley, Mechanicsville, VA (US); Logan M. Compton, Fredericksburg, VA (US); Marc W. Bassett, King George, VA (US); John W. Fraysse, Jr., Mechanicsville, VA (US)

(72) Inventors: Ryan T. Bosley, Mechanicsville, VA (US); Logan M. Compton, Fredericksburg, VA (US); Marc W. Bassett, King George, VA (US); John W. Fraysse, Jr., Mechanicsville, VA (US)

( * ) Notice: Subject to any disclaimer, the term of this patent is extended or adjusted under 35 U.S.C. 154(b) by 73 days.

(21) Appl. No.: 18/418,440

(22) Filed: Jan. 22, 2024

(65) Prior Publication Data

US 2025/0237484 A1 Jul. 24, 2025

(51) Int. Cl.
*F41G 7/36* (2006.01)

(52) U.S. Cl.
CPC ..... *F41G 7/36* (2013.01)

(58) Field of Classification Search
CPC ..... F41G 7/36; G01S 13/4427
See application file for complete search history.

(56) References Cited

U.S. PATENT DOCUMENTS

| | | | | |
|---|---|---|---|---|
| 3,312,423 | A * | 4/1967 | Welch | F41G 7/36 244/3.18 |
| 3,924,824 | A * | 12/1975 | Brodie | F41G 7/36 244/3.2 |
| 4,162,052 | A * | 7/1979 | Lamelot | F41G 7/303 244/3.16 |
| 4,173,785 | A * | 11/1979 | Licata | F41G 7/36 701/507 |
| 4,486,756 | A * | 12/1984 | Peregrim | G01S 13/4427 342/149 |
| 4,542,870 | A * | 9/1985 | Howell | F41G 7/222 244/3.15 |
| 6,493,651 | B2 * | 12/2002 | Harkins | G01C 17/38 356/141.2 |
| 6,725,173 | B2 * | 4/2004 | An | G01V 11/00 342/357.57 |
| 2002/0139942 | A1 * | 10/2002 | Cusick | G01S 17/46 250/559.29 |
| 2003/0016348 | A1 * | 1/2003 | Sallee | F41G 7/2293 356/141.1 |

* cited by examiner

*Primary Examiner* — Bernarr E Gregory

(57) ABSTRACT

An apparatus that includes at least two types of sensors arranged on a projectile, each type of sensor including a plurality of sensors with overlapping ranges.

20 Claims, 3 Drawing Sheets

SENSOR FARM

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to munitions. In particular, guidance systems for munitions.

SUMMARY

The present disclosure relates, in various embodiments, to at least two types of sensors arranged on a projectile, each type of sensor including a plurality of sensors with overlapping ranges. In various embodiments, the sensor types are selected from the group comprising gyroscopes, accelerometers, and magnetometers. In some embodiments, each sensor is individually calibrated and operates independently of the other sensors. In some embodiments, measurement noise and bias drift is reduced by sensor averaging. In some embodiments, a dynamic range is improved by including sensors of each type that cover different ranges. In some embodiments, the output of the selected sensors are fused into a composite output based on the appropriate range for the instantaneous flight dynamics. The final fused data provides a more reliable and precise measurement of the projectile's position, velocity, and orientation. In some embodiments, during less aggressive maneuvers, the ranges are selected to overlap so that the lower range sensor provide lower noise measurements and, during more aggressive maneuvers, higher range sensors provide acceleration measurement when the lower range sensors reach saturation. In some embodiments, a first type of sensor is a gyroscope. In some embodiments, the lower range sensor can measure roll up to 5 Hz and the higher range sensor measures an overlapping range that includes 5 hz. In some embodiments, the projectile is controlled using data from the higher range sensor during an initial portion of the flight and using data from the lower range sensor after a de-spinning maneuver allowing for more effective flight control. In some embodiments, a second type of sensor is an accelerometer. In some embodiments, high angular velocity measurements are improved by offsetting the plurality of accelerometers from a center of spin to obtain centripetal spin. Only accelerometers are required to be offset from the centerline. In some embodiments, the accelerometers are arranged on equal and opposite sides of the center of spin. In some embodiments, the sensors are arranged in a 0.2" grid on a 57 mm projectile. In some embodiments, a third type of sensor is a magnetometer. In some embodiments, gyroscope drift is mitigated by measuring the magnetometer position relative to a fixed magnetic field. In some embodiments, the plurality of types of sensors includes a first type being an accelerometer, the accelerometer providing centripetal spin data, a second type being a gyroscope, the gyroscope providing angular acceleration data which mitigates any noise, typically a high frequency noise, introduced by the accelerometer, and a third type being a magnetometer, the magnetometer providing position data relative to a fixed magnetic field which mitigates any drift introduced by the gyroscope. Averaging the sensor data from each type of sensor mitigates the noise and bias of a single sensor of that type and the output of the selected sensors are fused into a composite output based on the appropriate range for the instantaneous flight dynamics to improve overall accuracy. In some embodiments, a circuit, wherein the sensors are fixed to the circuit. In some embodiments, the sensors are fixed to the circuit with lead solder with sufficient malleability to withstand a high shock environment. In some embodiments, the sensors remain unpowered during a launch event to increase survivability of the sensors. In some embodiments, measurement robustness is improved due to redundant sensors in both number and type. This method effectively combines the data from multiple sensors, each with its own strengths and weaknesses, to create a more accurate and reliable system. It addresses common issues such as high-frequency noise in accelerometers and drift in gyroscopes, making it suitable for applications where precision and reliability are paramount.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are de-scribed in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
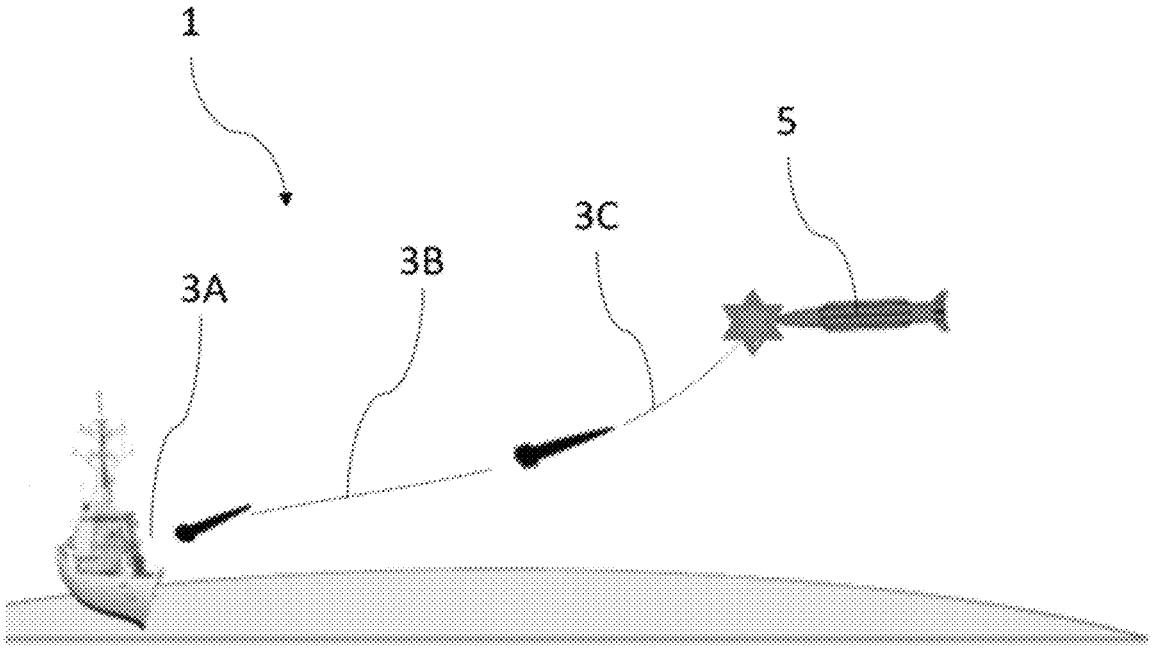
FIG. 1 is a view of a potential flight profile of a projectile.

FIG. 1 a view of a potential flight profile 1 of a projectile at three different stages of flight 3A-C. During an initial stage of flight 3A, when a projectile is launched from its platform, which may be a ship, an aircraft, or a ground-based launcher, it undergoes a rapid acceleration which includes a high spin component. While some spinning helps stabilize the projectile, a high spin rate can be detrimental to the operation of a variety of components including navigation components. High rates of spinning introduces significant noise in the navigational components which degrades the accuracy of the projectile. Accordingly, the projectile may deploy a de-spin maneuver through a control surface to counteract the spinning motion to lower the spin rate during an intermediate stage 3B of flight. In one embodiment, the spin rate is reduced to 5 Hz or less. At a lower spin rate during the intermediate stage 3B, the projectile can be guided with greater accuracy due to the reduction in noise created by high rates of spin. As the projectile nears the target 5 in a final stage 3C, the projectile may require high acceleration maneuvers that radically change the projectiles direction and introduce high rates of spin or rotation of the projectile so that the projectile can hit the target. High rates of spin or rotation can include high-g maneuvers or angular accelerations.

Each of these types of sensors have overlapping strengths and weaknesses which improves the overall output of the sensor farm. Additionally, the sensors are selected with overlapping ranges to address control in the different stages 3A-C of the flight. Each sensor is individually calibrated and individually operated in order to be able to generate sensor data without the bias of the other sensors. The noise and bias drift of each sensor is further reduced by the use of sensor averaging. For each type of sensor (accelerometers, gyroscopes, and magnetometers), the outputs of the individual sensors are mathematically averaged. Sensor averaging improves overall accuracy by totaling the outputs of each type of sensor and fuses each sensors output into a composite output based on the appropriate range for the instantaneous flight dynamics. After averaging the data from each type of sensor, sensor fusion techniques are applied. Sensor fusion involves combining the data from different sensors to obtain a comprehensive and accurate representation of the projectile's motion. Fusing the data from each sensor type considers the strengths of each sensor type and compensate for their individual limitations. Algorithms such as Kalman filtering or complementary filtering can be used to fuse the accelerometer, gyroscope, and magnetometer data. These algorithms consider the strengths of each sensor type and compensate for their individual limitations.

Gyroscopes measure the projectile's rotation or angular velocity. Using the principle of angular momentum, gyroscopes maintain a constant orientation in space. When the projectile rotates, the gyroscope detects this change and provides data on the rate and direction of rotation. This information is crucial for maintaining the correct orientation and for making adjustments during flight to ensure the projectile stays on its intended path. In the present application, gyroscopes in two ranges may be selected such as a 0-200 Hz gyroscope may be used to address the high spin rates in stages 3A and 3C, while a 0-5 Hz gyroscope may be used for greater control in the lower spin rate in stage 3B. Further, during less aggressive maneuvers, the ranges are selected to overlap so that the lower range sensor provide lower noise measurements and, during more aggressive maneuvers, higher range sensors provide measurement when the lower range sensors reach saturation. However, one drawback to the exclusive use of gyroscopes is the bias drift.

Accelerometers can also be used to measure angular acceleration by placing them in an offset position from the center of spin. Angular acceleration is the rate of change of angular velocity over time. In simpler terms, it's how quickly a projectile is spinning faster or slower. By placing accelerometers at a distance (offset) from the axis of rotation, they can be used to measure angular acceleration. This is because, as the projectile rotates, the accelerometers experience a change in their velocity due to the rotation. When the projectile rotates, the accelerometers, being offset from the center, follow a circular path. The linear acceleration that these accelerometers measure is a component of the rotational motion. By knowing the distance of the accelerometers from the axis of rotation (the radius of the circular path), the angular acceleration can be calculated. In the present application, accelerometers are used to replace some if not all gyroscopes to lower the overall cost because they tend to be less expensive. However, accelerometers are sensitive to various forms of noise and interference. In the context of projectiles, they can be affected by high levels of vibration and shock, leading to noisy data. Rapid acceleration and deceleration can generate significant signal noise, making it difficult to obtain accurate readings. Further, accelerometers must be capable of measuring the wide range of accelerations experienced by the projectile, from launch to impact. Finding an accelerometer with the appropriate dynamic range and sensitivity can be challenging. Accordingly, in the present application, accelerometers are chosen with overlapping ranges. Some of the accelerometers are low range and, on the same projectile, the rest of the accelerometers measure a higher range which overlaps with the lower range.

Magnetometers can also be used to measure angular acceleration. Magnetometers are used to measure the strength and direction of magnetic fields. When a projectile is equipped with a magnetometer, it can sense variations in the Earth's magnetic field as it moves and rotates. By tracking these changes, the magnetometer provides information about the orientation of the projectile. As the projectile moves and rotates, the magnetometer collects magnetic field data at various points in time. By analyzing changes in the magnetic field data, it's possible to determine how the orientation of the projectile is changing over time. The rate of change of orientation is the angular velocity. This can be calculated by differentiating the orientation data with respect to time. In the present application, magnetometers may be used in conjunction with gyroscopes and accelerometers, to improve accuracy. However, magnetometers are subject to magnetic interference from anomalies in the Earth's magnetic field. Accordingly, in the present application magnetometers can be used in a complimentary manner with accelerometers and gyroscopes with each type of sensor covering the drawbacks of the other types of sensors. Specifically, the magnetometer can address bias drift present in gyroscopes because the magnetometer measures location based on Earth's magnetic field. For the purpose of short range flights, the Earth's magnetic field can be considered as fixed.

All three types of sensors are subject to extreme G-forces (high shock), especially during launch and impact. Accordingly, in some embodiments, the sensors are connected to the circuit using lead solder that is sufficiently malleable to withstand high shock environments. Further, in some embodiments, the sensors remain unpowered during launch to increase their survivability.

Figure 2A:
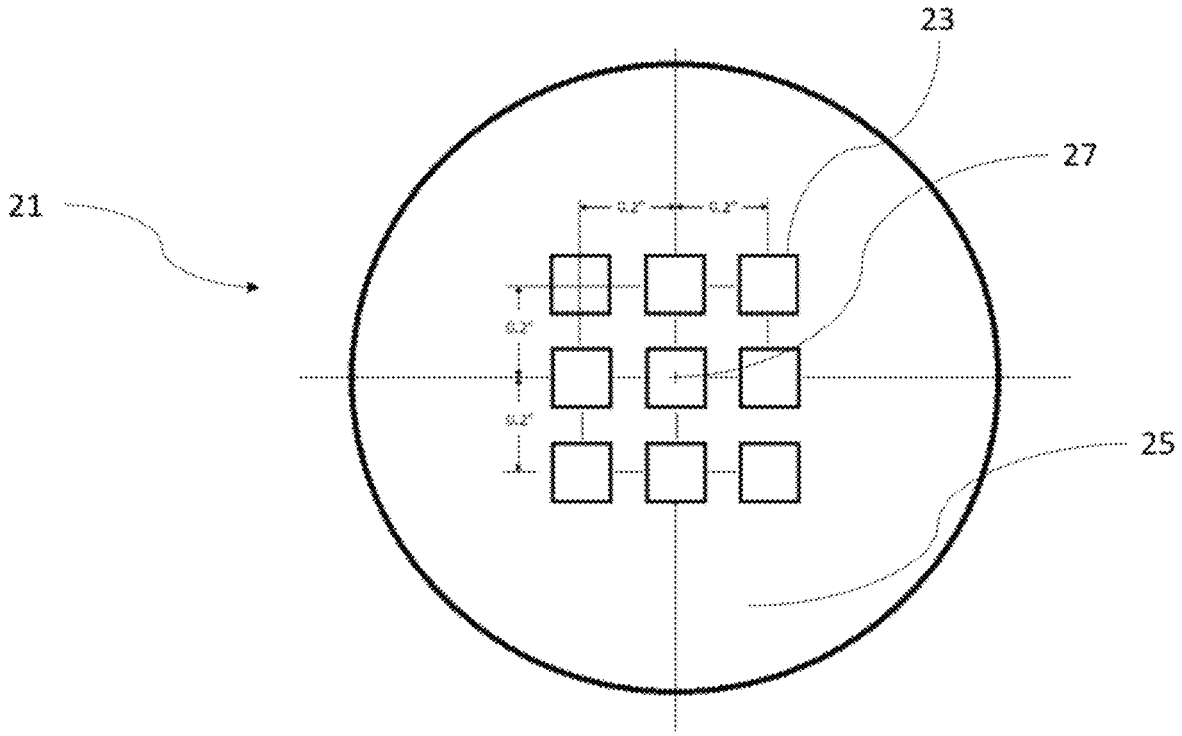
FIG. 2A shows an exemplary sensor farm.

FIG. 2A shows an exemplary sensor farm 21. Sensor farm 21 is mounted on a chip 25 that is centered on the center of spin 27 of a projectile (not shown). In this embodiment, sensors 23 represents a 3-axis gyroscope and 3-axis accelerometer. As such, in this embodiment, there are nine (9) 3-axis gyroscope and nine (9) 3-axis accelerometers arranged about a center of spin 27 in a 0.2" by 0.2" inch grid. As shown in this embodiment, the gyroscopes and accelerometers 23 are offset from the center of spin 27 which allows the accelerometers to obtain a centripetal spin measurement. Also shown in this embodiment, the accelerometers and gyroscopes are arranged on equal and opposite sides of the center of spin 27. Other configurations of the sensors may be used without deviating from this disclosure.

Figure 2B:
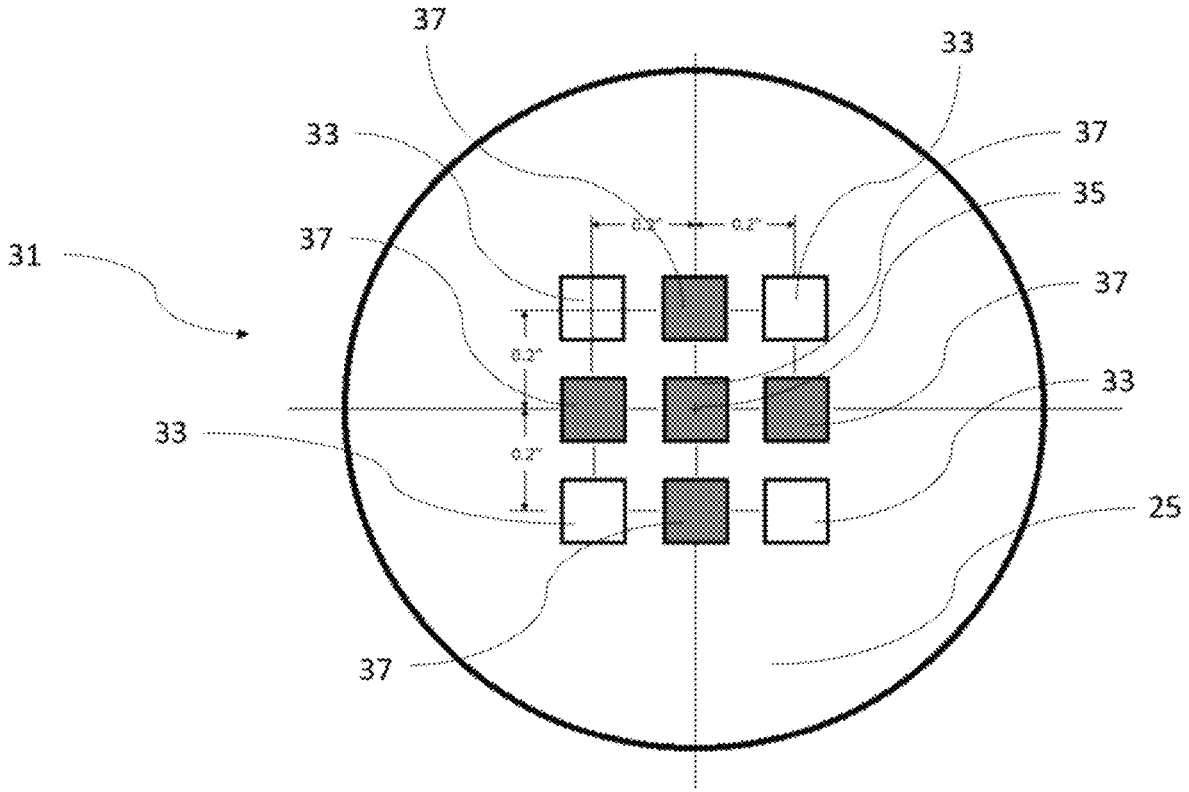
FIG. 2B shows another exemplary sensor farm.

FIG. 2B shows another exemplary sensor farm 31. This configuration may be used in conjunction with the sensor farm shown in FIG. 2A. In some embodiments, sensor farm 21 and 31 may be manufactured on opposing sides of the same chip 25. In sensor farm 31, sensor 33 is an accelerometer and/or gyroscope and sensor 37 is a plurality of magnetometers.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus comprising:

at least two types of sensors arranged on a projectile, each type of sensor including a plurality of sensors with overlapping measurement ranges, wherein measurement noise and bias drift is reduced by sensor averaging.

2. The apparatus of claim 1, wherein the sensor types are selected from the group consisting of gyroscopes, accelerometers, and magnetometers.

3. The apparatus of claim 2, wherein the sensors are arranged in a 0.2 inch grid on a 57 mm projectile.

4. The apparatus of claim 1, wherein each sensor is individually calibrated and operates independently of the other sensors.

5. The apparatus of claim 1, wherein a dynamic range is improved by including sensors of each type that cover different ranges.

6. The apparatus of claim 5, wherein the outputs of the selected sensors are fused, by a fusion processor, into a composite output based on the appropriate measurement range for the instantaneous flight dynamics.

7. The apparatus of claim 5, wherein, during less aggressive maneuvers, the measurement ranges are selected to overlap so that the lower range sensors provide lower noise measurements, and during more aggressive maneuvers, higher range sensors provide acceleration measurement when the lower range sensors reach saturation.

8. The apparatus of claim 7, wherein a first type of sensor is a gyroscope.

9. The apparatus of claim 8, wherein the lower range sensor can measure roll up to 5 Hz and the higher range sensor measures an overlapping range that includes 5 Hz.

10. The apparatus of claim 9, wherein the projectile is controlled, by a flight control surface, using data from the higher range sensor during an initial portion of the flight and using data from the lower range sensor after a de-spinning maneuver allowing for more effective flight control.

11. The apparatus of claim 7, wherein a second type of sensor is an accelerometer.

12. The apparatus of claim 11, wherein high angular velocity measurements are improved by offsetting the plurality of accelerometers from a center of spin to obtain centripetal spin.

13. The apparatus of claim 12, wherein the accelerometers are arranged on equal and opposite sides of the center of spin.

14. The apparatus of claim 7, wherein a third type of sensor is a magnetometer.

15. The apparatus of claim 14, wherein gyroscope drift is mitigated by measuring the magnetometer position relative to a fixed magnetic field.

16. The apparatus of claim 1, wherein the plurality of types of sensors further includes:

a first type being an accelerometer, the accelerometer providing centripetal spin data;

a second type being a gyroscope, the gyroscope providing angular acceleration data which mitigates any noise introduced by the accelerometer; and a third type being a magnetometer, the magnetometer providing position data relative to a fixed magnetic field which mitigates any drift introduced by the gyroscope;

wherein a processing system performing averaging of the sensor data from each type of sensor mitigates the noise and bias of a single sensor of that type and the outputs of the selected sensors are fused by a fusion processor into a composite output based on the appropriate measurement range for the instantaneous flight dynamics to improve overall accuracy.

17. The apparatus of claim 1, further comprising:

a circuit, wherein the sensors are fixed to the circuit.

18. The apparatus of claim 17, wherein the sensors are fixed to the circuit with lead solder with sufficient malleability to withstand a high shock environment.

19. The apparatus of claim 1, wherein the sensors remain unpowered during a launch event to increase survivability of the sensors.

20. The apparatus of claim 1, wherein the sensors are connected to a circuit using lead solder with sufficient malleability to withstand a high shock environment.

* * * * *